US005239228A

United States Patent [19]

Taniguchi et al.

[11] Patent Number: 5,239,228

[45] Date of Patent: Aug. 24, 1993

[54] THIN-FILM ELECTROLUMINESCENCE DEVICE FOR DISPLAYING MULTIPLE COLORS WITH GROOVE FOR CAPTURING ADHESIVE

[75] Inventors: Kouji Taniguchi; Shigeo Nakajima; Masaru Yoshida, all of Nara, Japan

[73] Assignee: Sharp Kabushiki Kaisha, Osaka, Japan

[21] Appl. No.: 723,907

[22] Filed: Jul. 1, 1991

[30] Foreign Application Priority Data

Jul. 2, 1990 [JP] Japan ..... 2-175975
Jul. 11, 1990 [JP] Japan ..... 2-184972

[51] Int. Cl.[5] ..... H01J 1/66; H01J 61/40

[52] U.S. Cl. ..... 313/512; 313/509; 313/112

[58] Field of Search ..... 313/502, 503, 506, 509, 313/512, 112, 408

[56] References Cited

U.S. PATENT DOCUMENTS

| | | | |
|---|---|---|---|
| 3,569,761 | 6/1969 | Lange | 313/408 |
| 4,357,557 | 11/1982 | Inohora et al. | 313/509 |
| 4,745,327 | 5/1988 | Saeki et al. | 313/112 |
| 4,839,557 | 6/1989 | Schrank | 313/509 |
| 4,983,469 | 1/1991 | Huzino et al. | 313/506 |

FOREIGN PATENT DOCUMENTS

| | | |
|---|---|---|
| 57-25692 | 2/1982 | Japan . |
| 58-35587 | 3/1983 | Japan . |
| 61-57497 | 4/1986 | Japan . |
| 63-121296 | 5/1988 | Japan . |
| 63-148597 | 6/1988 | Japan . |
| 63-224190 | 9/1988 | Japan . |
| 64-67895 | 3/1989 | Japan . |
| 1-142593 | 6/1989 | Japan . |

*Primary Examiner*—Donald J. Yusko
*Assistant Examiner*—J. E. Guist

[57] ABSTRACT

A thin-film electroluminescence (EL) device capable of displaying multiple colors has a laminated structure wherein back electrodes in stripes, a lower dielectric layer, a luminescence layer, an upper dielectric layer and transparent electrodes in stripes are sequentially formed on a transparent substrate in this order. The back electrodes intersect the transparent electrodes at right angles, and areas of the device where the back electrodes confront the transparent electrodes form picture elements. This device also has at least first and second color filters. The first and second filters are placed not only in corresponding picture-element areas of the transparent electrodes, but also in non-picture-element areas of the transparent electrodes and an upper dielectric layer such that the first color filter overlaps the second color filter in the non-picture-element areas. The first and second color filters in combination have transmissivities to visible lights similar to those of a black filter, thereby restraining external light coming to the non-picture-element areas from being reflected. Further, the device can include a groove in a transparent sealing plate formed above the transparent electrode. The transparent sealing plate is bonded to the transparent substrate with an adhesive and the groove captures excess adhesive to avoid interference between the adhesive and the picture elements.

4 Claims, 10 Drawing Sheets

THIN-FILM ELECTROLUMINESCENCE DEVICE FOR DISPLAYING MULTIPLE COLORS WITH GROOVE FOR CAPTURING ADHESIVE

BACKGROUND OF THE INVENTION

1. Field of the Invention

The present invention relates to a thin-film electroluminescence (EL) device capable of displaying multiple colors using color filters.

2. Description of the Prior Art

Generally, thin-film EL devices have a laminated structure wherein a plurality of thin layers or films are superimposed on one another.

FIG. 1 shows a conventional thin-film EL device having such a laminated structure and designed to display multiple colors. This EL device has a glass substrate 71, upper and lower electrodes, i.e., transparent electrodes and back electrodes 76 and 72, a luminescent layer 74, and upper and lower dielectric layer 75 and 73. The lower electrodes 72 are formed of Al in stripes on the glass substrate 71. The lower dielectric layer 73, the luminescent layer 74 and the upper dielectric layer 75 are sequentially formed over the lower electrodes in this order. The upper electrodes 76 made of ITO (indium tin oxide) in stripes are disposed on the upper dielectric layer 76 in such a manner as to intersect the lower electrodes 72 at right angles. Areas of the EL device where the lower and upper electrodes 72 and 76 are intersecting each other, in other words, where the lower and upper electrodes are opposed to each other, are used as picture elements. On the upper electrodes 76 are formed red and green filters alternately.

When Al electrodes are used as in the above conventional thin-film EL device, light coming from the outside tends to be reflected by the Al electrodes. This is main factor of light reflection in thin-film EL devices having Al electrodes. In addition to this factor, the laminated structure also causes light reflection to occur in the interface between the layers even though each layer is transparent. In other words, thin-film EL devices having a laminated structure tend to have a high reflectance. This is of course true with the conventional thin-film EL device of FIG. 1 and what is worse, incident light from the outside tends to be reflected not only in the picture-element areas but also in non-picture-element areas between the picture elements. Light reflection caused by the above factors eventually causes a white display and the display quality is lowered.

In order to avoid reflection of light coming from the outside, another prior art thin-film EL device has a black filter in the non-picture-element areas. A black filter can absorb external light well, so that reflected light can be greatly reduced. In this case, however, a comparatively time-consuming step of forming the black filter is required. As a result, production costs increase.

SUMMARY OF THE INVENTION

A first object of the present invention is therefore to provide a thin-film EL device which can restrain incident light from being reflected, thereby offering a multicolor display of good quality, without raising production costs.

A second object of the present invention is to provide a thin-film EL device adapted to display multiple colors and having a sealing plate which can be fixed to a substrate without affecting picture elements with adhesive squeezed out.

In order to accomplish the first object, the present invention improves on a thin-film EL device which comprises a luminescent layer; upper and lower electrodes in stripes formed in a manner sandwiching the luminescent layer therebetween through upper and lower dielectric layers, respectively, said upper electrodes intersecting said lower electrodes at right angles so that areas of the thin-film electroluminescence device where the upper electrodes are opposed to respective ones of the lower electrodes form picture elements each of which is allowed to emit light when an electric voltage is applied to corresponding upper and lower electrodes; and a plurality of color filters which have first portions placed opposite the corresponding picture elements and which each have a transmission characteristic to visible light different from those of the others.

In the thin-film EL device according to the present invention, at least two of said plurality of color filters further have second portions placed in non-picture-element areas other than the picture-elements in such a manner that the second portions of one of said at least two color filters are superimposed on the corresponding second portions of the other, thus forming filter overlapping portions, and said filter overlapping portions have a transmission characteristic to visible light similar to that of a black filter.

The filter overlapping portions restrain external light coming into the non-picture-element areas from being reflected, thus improving display quality. Furthermore, because a further step of forming a black filter is not required, this thin-film EL device can be produced without raising a cost.

Preferably, a red filter and a green filter are used as color filters forming the filter overlapping portions.

When there are picture elements for emitting yellow light, it is desirable to provide the picture elements with a yellow filter such that external light coming to these picture elements can be restrained from being reflected. This yellow filter can also control the tone of a yellow.

In order to accomplish the second object, the present invention provides a thin-film electroluminescence device comprising a transparent substrate, first electrodes formed on the substrate, a first dielectric layer formed on the first electrodes, a luminescent layer formed on the first dielectric layer, a second dielectric layer formed on the luminescent layer, second electrodes formed on the second dielectric layer, and a transparent sealing plate formed above the second electrodes and having, in its own periphery, a bonded portion which is adhesive-bonded to a peripheral portion of the substrate where no picture elements are provided, said sealing plate having a groove inside of and along said bonded portion.

The groove of the sealing plate serves as a reservoir or container for a squeeze-out adhesive used for fixing the sealing plate to the substrate. Therefore, the picture elements are not affected by the adhesive squeezed out, thereby offering a good quality color display.

Color filters are formed between the second electrodes and the sealing plate. To obtain a multicolor display of good quality, a substrate-side surface of the sealing plate should be flat.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

First Embodiment

Figure 1:
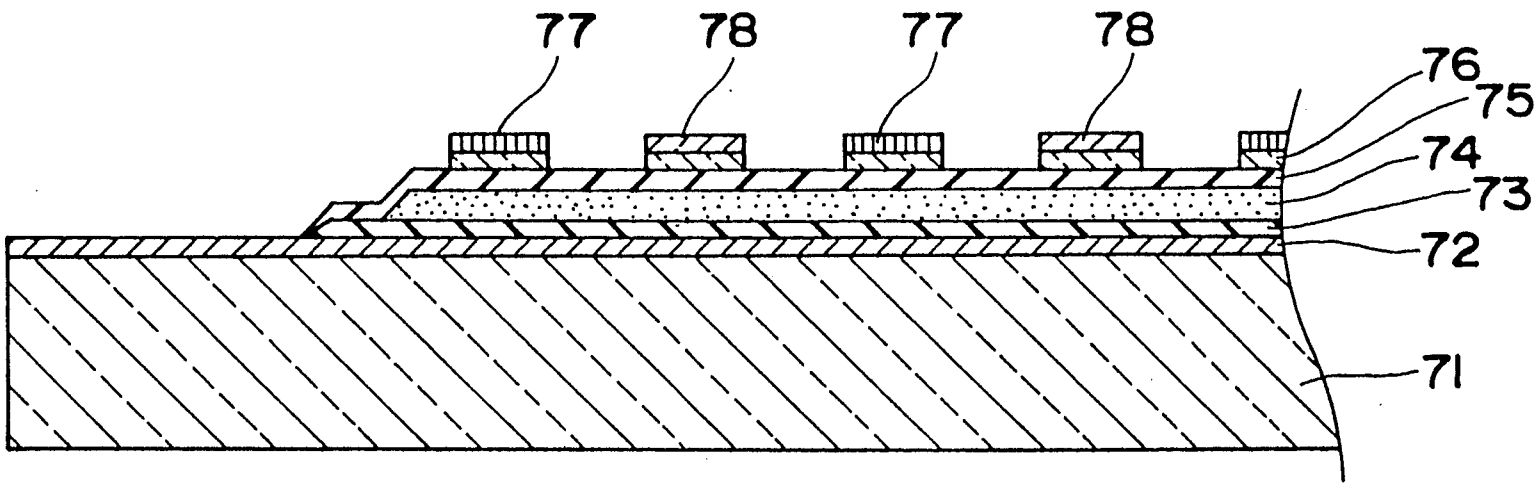
Fig. 1 PRIOR ART
FIG. 1 is a sectional view of the aforementioned prior art thin-film EL device having color filters.
Figure 2:
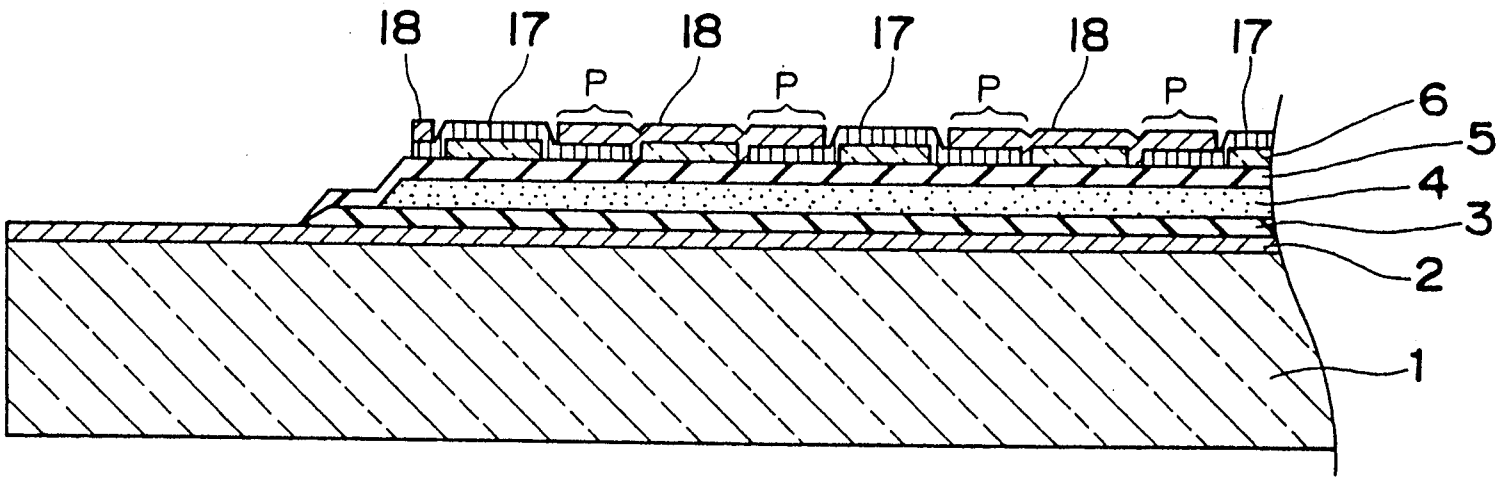
FIG. 2 is a sectional view of a thin-film EL device according to a first embodiment of the present invention.

A thin-film EL device of a first embodiment is shown in FIG. 2.

In FIG. 2, a reference number 1 indicates a glass substrate, reference numbers 2 and 6 respectively indicate lower electrodes (back electrodes) formed of Al in stripes and upper electrodes (transparent electrodes) formed of ITO in stripes, a reference number 3 indicates a lower dielectric layer constituted from a laminated film of $Si_3N_4/SiO_2$, a reference number 5 indicates an upper dielectric layer constituted from a laminated film of $Al_2O_3/Si_3N_4$, and a reference number 4 indicates a luminescent layer formed of Zns:Mn. Areas where the lower electrodes 2 are opposed to the upper electrodes 6 form picture elements. Areas of the upper electrodes corresponding to the picture elements will be referred to as picture-element areas below. On the other hand, areas of the upper electrodes and the upper dielectric layer other than the picture elements will be referred to as non-picture-element areas.

The EL device has a red filter 17 and a green filter 18. In the following description, these reference numbers 17 and 18 are used not only for the red filter and green filter but also for portions of these filters. The red and green filters 17 and 18 are respectively patterned so that red filter portions 17 and green filter portions 18 are alternately placed on the corresponding picture-element areas. The red filter portions 17 and green filter portions 18 on the respective picture-element areas continue to the non-picture-element areas surrounding the picture-element areas. As a result, in all of the non-picture-element areas are disposed both red and green filter portions.

The red filter 17 is first formed in the corresponding picture-element areas and the non-picture-element areas surrounding these picture-element areas, and then the green filter 18 is similarly formed in the corresponding picture-element areas and the non-picture-element areas so that the green filter 18 overlaps the red filter 17 in the non-picture-element areas. As a result, color-filter overlapping portions P of the red and green filters 17 and 18 are formed in the non-picture-element areas as shown in FIG. 2.

The red and green filters are formed by a dyeing method, a pigment dispersion photoreceptor method or another method.

Figure 7:
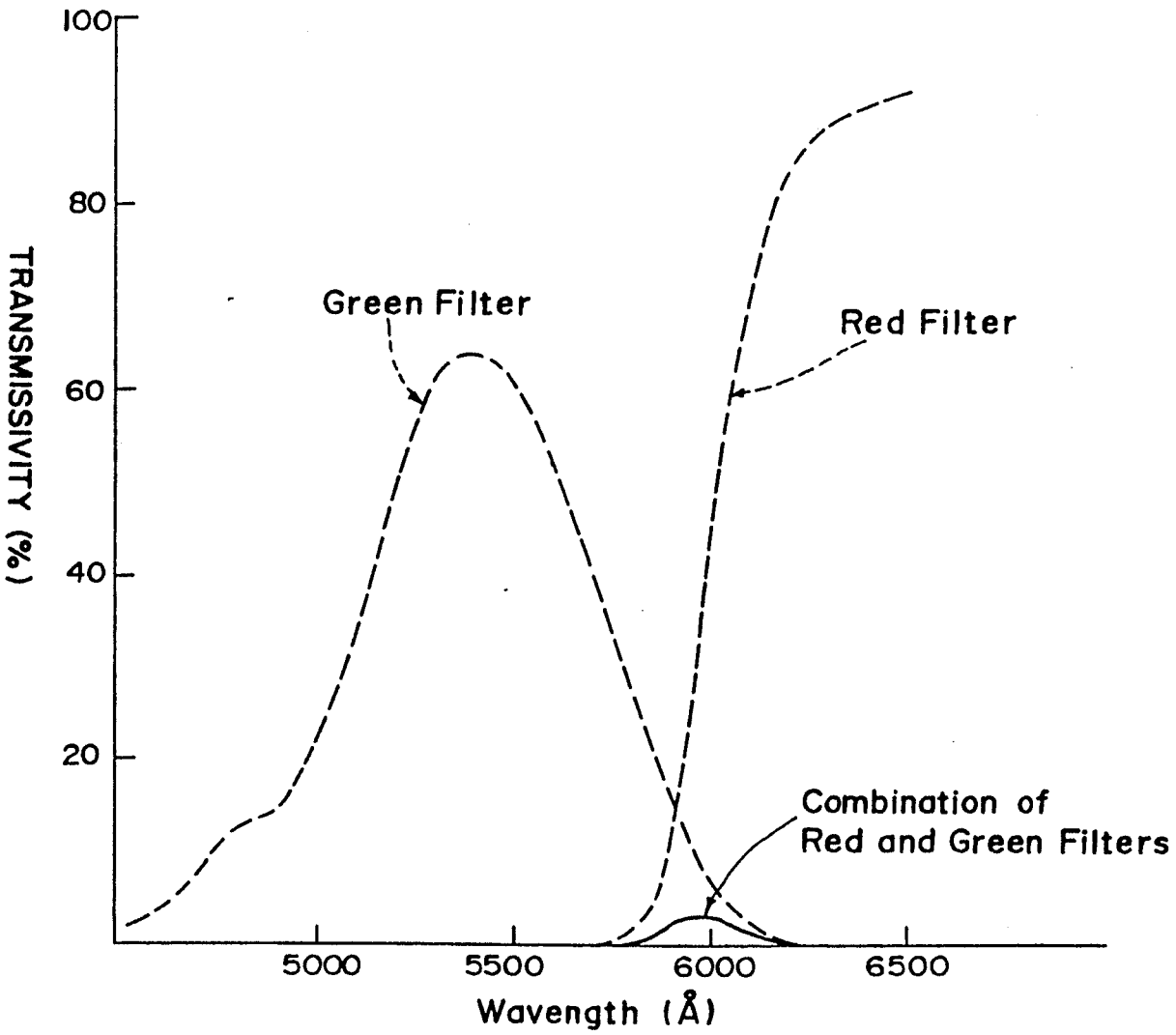
FIG. 7 is a graph showing transmission characteristics of color filters.

As shown in FIG. 7, the color-filter overlapping portions P have a spectrum of transmissivities, indicated by a solid line, similar to that of a black filter wherein transmissivities are almost zero in an almost whole range of visible light. This means that the color-filter overlapping portions P of this embodiment will absorb visible light coming from the outside as a black filter does and that reflected light can be greatly reduced without the placing a black filter. Thus, color display of a good quality is obtained without raising a production cost. This is true with other embodiments of the present invention (described later) that have such color-filter overlapping portions of red and green filters.

Incidently, if a ZnS:Mn film constituting the luminescent layer 4 is formed by an electronic beam deposition method, the ZnS:Mn film is of a cubic system. $Mn^{2+}$ ions in a cubic ZnS:Mn film has a luminescence spectrum which has its peak at a wavelength of 5850 Å, so that this film emits yellowish orange light.

On the other hand, if the ZnS:Mn film is formed by a chemical vapor deposition method, this ZnS:Mn film is of a hexagonal system. Mn ions in a hexagonal ZnS:Mn film has a luminescence spectrum which has its peak at a wavelength of 5800 Å, so that this film emits yellow light.

When a cubic ZnS:Mn film having a yellowish orange luminescent color is used as the luminescent layer 4, red light emitted from picture elements provided with a red filter has a high luminance. On the other hand, when a hexagonal ZnS:Mn film having a yellow luminescent color is used as the luminescent layer 4, green light emitted from picture elements provided with a green filter has a high luminance.

In general, a high luminance is required for the green color. Therefore, it is preferable to form the luminescent layer 4 of hexagonal ZnS:Mn. This is true with the following embodiments.

Second Embodiment

Figure 3:
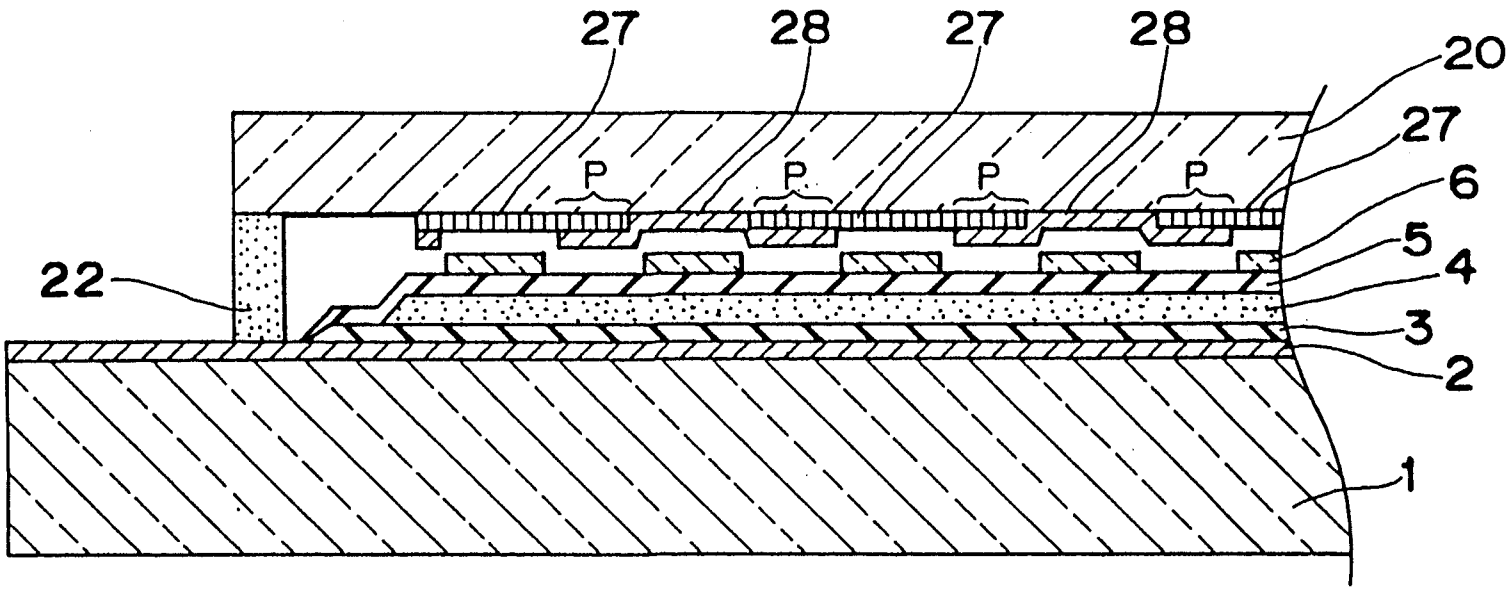
FIG. 3 is a sectional view of a thin-film EL device according to a second embodiment of the present invention.

A thin-film EL device of a second embodiment is shown in FIG. 3. This embodiment is different from the first embodiment in that color filters of this embodiment are not formed in contact with the upper electrodes 6 and the upper dielectric layer 5, as described below.

In this embodiment, red and green filters 27 and 28 are formed on a flat lower surface of a sealing glass plate 20 which is provided above the upper electrodes 6. The sealing glass plate 20 is bonded to a peripheral portion of the substrate 1 by adhesive 22. In the following description, the reference numbers 27 and 28 are used not only for the red filter and the green filter but also for portions of these filters.

The red filter 27 and the green filter 28 are respectively patterned so that red filter portions 27 and green filter portions 28 are alternately placed in areas of the sealing glass plate surface which are opposed to the picture-element areas and the red filter portions 27 and the green filter portions 28 are overlapped in areas of the sealing glass plate surface which are opposed to the non-picture-element areas surrounding the picture-element areas.

The red filter 27 is first formed on the sealing glass plate 20 and then the green filter 28 is formed so that the green filter 28 overlaps the red filter 27 in areas corresponding to the non-picture-element areas. As a result, color-filter overlapping portions P of the red and green filters 27 and 28 are formed in the areas of the sealing glass plate surface corresponding to the non-picture-element areas as shown in FIG. 3. A dyeing method, a pigment dispersion photoreceptor method or other method is used for forming these filters 27 and 28. In this embodiment, because the red filter 27 is first formed on the flat surface of the sealing glass plate 20, the red filter 27 is also flat.

The filter overlapping portions P of the red and green filters 27, 28 have an effect similar to that produced by a black filter, as described in detail above in connection with the first embodiment. Therefore, a good display performance is obtained without raising a production cost.

Third Embodiment

Figure 4:
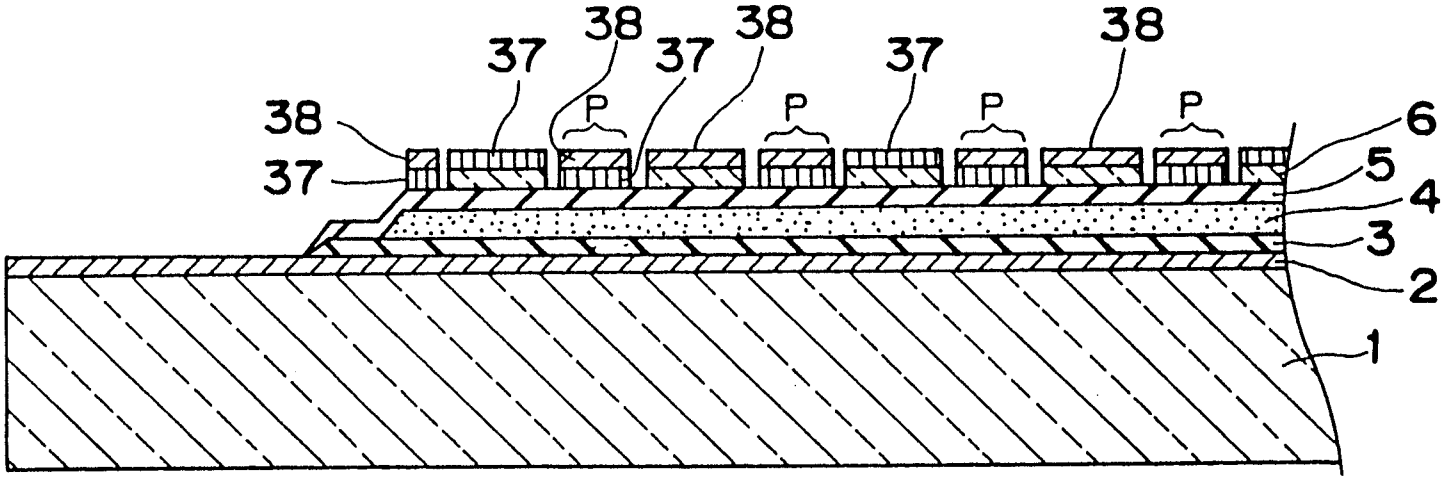
FIGS. 4 and 5 are sectional views of a thin-film EL device according to a third embodiment of the present invention.
Figure 5:
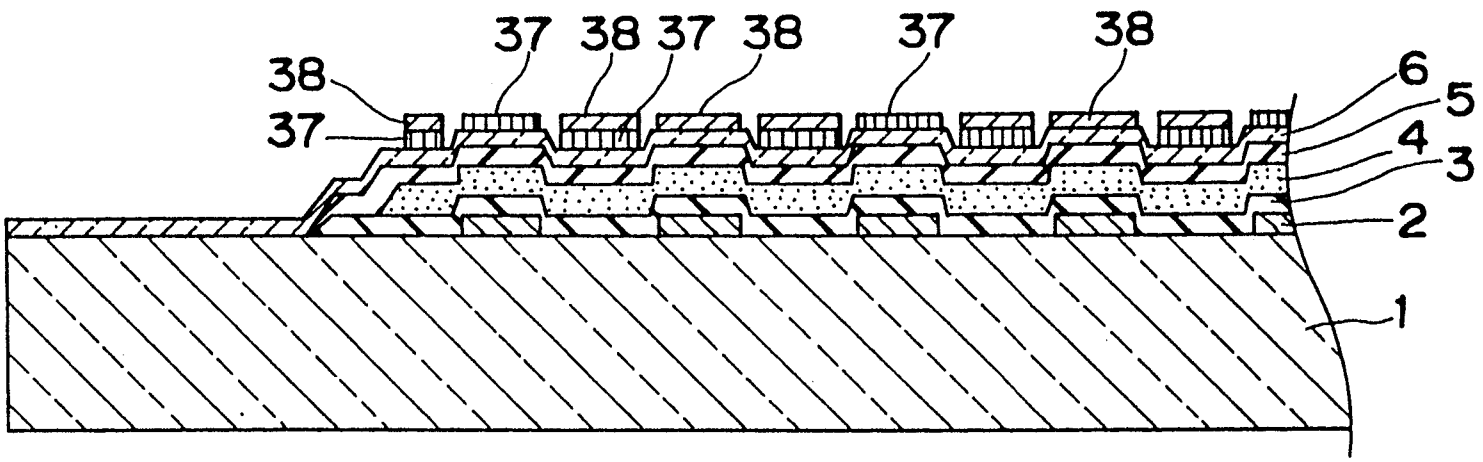

A thin-film EL device of a third embodiment is shown in FIGS. 4 and 5. FIG. 4 shows a sectional view of the device taken along a lower electrode 2, and FIG. 5 shows a sectional view of the device taken along an upper transparent electrode 6.

This embodiment is different from the first embodiment in that the red and green filter portions, each of which covers a corresponding picture-element area and its surrounding non-picture-element area continuously in the first embodiment, are not continuous in the present embodiment, as described below.

Reference numbers 37 and 38 are used not only for red and green filters but also for portions of these filters in the following description. Red and green filter portions 37 and 38 positioned in the picture-element areas are separated from the other portions positioned in the non-picture-element areas. Patterning of these filters 37 and 38 is easily done by photolithograpy.

Fourth Embodiment

Figure 6:
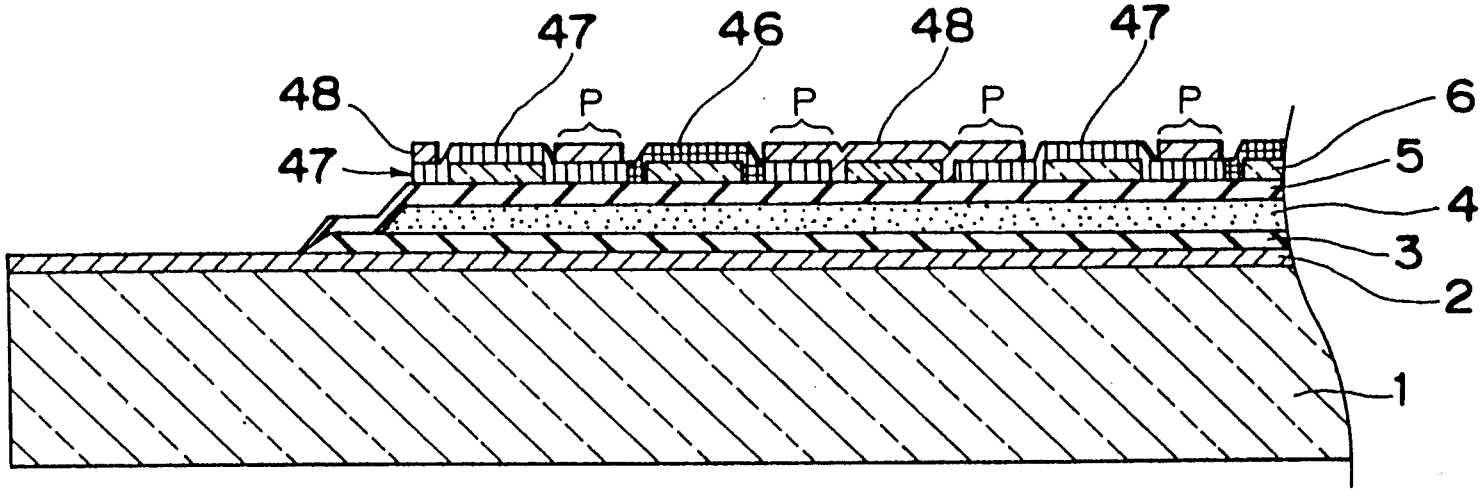
FIG. 6 is a sectional view of a thin-film EL device according to a fourth embodiment of the present invention.

A thin-film EL device of a fourth embodiment is shown in FIG. 6.

This embodiment is different from the preceding embodiments in that a yellow filter is further used and that the luminescent layer 4 is limited to one which is made of hexagonal ZnS:Mn, thus emitting yellow light. Specifically, the EL device of this embodiment has yellow, red and green filters 46, 47 and 48. The yellow, red, and green filters 46, 47, 48 are formed by a dyeing method, a pigment dispersion photoreceptor method or other method. In the following description, these reference numbers 46–48 are used not only for the yellow, red and green filters but also for portions of these filters. These three different color filters 46, 47 and 48 are patterned so that red filter portions 47, yellow filter portions 46 and green filter portions 48 are placed by turns in this order in the picture-element areas. In other words, red filter portions 47, yellow filter portions 46 and green filter portions 48 are provided in every three picture-element areas, respectively.

Each red filter portion 47 positioned in a picture-element area stretches into its surrounding non-picture-element area. Other red filter portions 47 are positioned in the other non-picture-element areas on the upper dielectric layer 5 between the picture-element areas provided with the yellow and green filters 46 and 48, respectively.

Due to the pattern of the red filter 47, each of yellow filter portions 46 is surrounded by the red filter portions 47 placed in the non-picture-element areas.

On the other hand, the green filter 48 is patterned so that each green filter portion 48 positioned in the corresponding picture-element area stretches into its surrounding non-picture-element area. Each green filter portion 48 in the non-picture-element area surrounding the corresponding picture-element area is superimposed on the red filter 47. Further green filter portions 48 are superimposed on the red filter portions 47 positioned in the other non-picture-element areas on the upper dielectric layer 5 between the picture-element areas provided with the red and yellow filters 47 and 46, respectively. Consequently, filter overlapping portions P of the red and green filters 47 and 48 are formed in the non-picture-element areas.

Like the preceding embodiments, the thin-film EL device of this embodiment can also display multiple colors of good quality without raising a production cost because external light coming to the non-picture-element areas is well absorbed by the filter overlapping portions P, resulting in a considerable decrease of reflected light, and it is not necessary to further form a black filter.

In addition, in this embodiment, the yellow filter 46 is also provided to allow corresponding picture elements to emit yellow light. Because the luminescent color of the luminescent layer 4 is yellow, it may be possible to omit this yellow filter 46. However, owing to the yellow filter 46, light components of external light other than the yellow light components are well absorbed and not reflected. As a result, a good contrast is obtained, when compared with a case wherein picture elements for displaying yellow are not provided with a yellow filter. Furthermore, the yellow filter 46 can control the tone of the luminescent color to a desired one, thus improving the display quality.

In the first through fourth embodiments, each color-filter overlapping portion P is constituted from the red and green filters. However, a blue filter can be used instead of the green filter. Light coming from outside to the non-picture-element areas is well absorbed and reflection of incident light is greatly lessened in this case, too. Moreover, in the above embodiments, the red filter underlies the green filter. However, the red filter may be superimposed on the green filter. The point is that different color filters should be selected so that a combination of the selected color filters has transmissivities similar to those of a black filter relative to visible lights.

Fifth Embodiment

Figure 8:
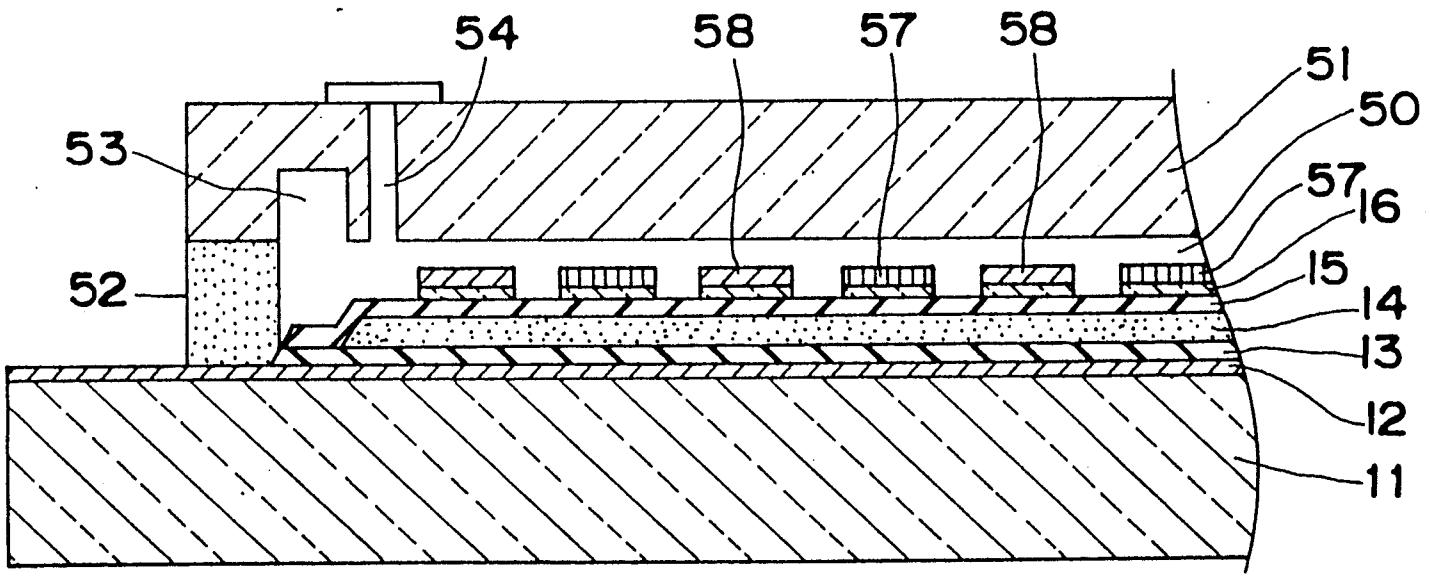
FIG. 8 is a sectional view of a thin-film EL device according to a fifth embodiment of the present invention.

A thin-film EL device of a fifth embodiment is shown in FIG. 8. In FIG. 8, a reference number 11 indicates a transparent substrate, reference numbers 12 and 16 respectively indicate lower electrodes formed of A; in stripes and upper electrodes formed of ITO in stripes (the upper electrodes 16 are transparent), a reference number 13 indicates a lower dielectric layer constituted from a laminated film of $Si_3N_4/SiO_2$, a reference number 15 indicates an upper dielectric layer constituted from a laminated film of $Al_2O_3/Si_3N_4$, and a reference number 14 indicates a luminescent layer formed of Zns containing Pr and F (ZnS: Pr,F). The luminescent color of the luminescent layer 15 is white. Parts where the lower electrodes 12 confront the upper electrodes 16 form picture elements.

The transparent upper electrodes 16 are provided with color filters 57 and 58 of two different colors alternately. These color filters 57 and 58 are formed by a gelatine dyeing method, an electrolytic deposition method, or other methods.

There is provided a transparent sealing glass plate 51 over the color filters 57 and 58. This transparent sealing glass 51 is flat especially in a central part opposed to the picture elements. Therefore, light emitted from each picture element can be effectively extracted through the corresponding color filters. Being transparent and flat is an indispensable condition of a sealing plate for color display using color filters.

The sealing glass plate 51 is bonded to the periphery of the substrate 11 by adhesive 52 constituted from an epoxy resin containing glass powder of 1–50 μm in diameter. Owing to the sealing glass plate 51 adhesive-bonded to the substrate 11 tightly around the periphery, external gases are prevented from entering the device. Accordingly, the thin-film EL device of this embodiment has a good moisture-resistance property. The sealing glass plate 51 has a groove 53 at a peripheral portion not opposed to any picture element. The groove 53 circulates along the peripheral portion adhesive-bonded to the substrate. This groove 53 serves as a reservoir or container for squeeze-out of adhesive 52. Specifically, when the sealing glass plate 51 is adhesive-bonded, adhesive 52 squeezed out inwardly enters the groove 53 and does not affect the picture elements. Therefore, this device offers a high reliability.

The sealing glass plate 51 is also provided with a hole 54 to be used as an outlet for gases as well as an inlet for an insulation oil 50.

Figure 10:
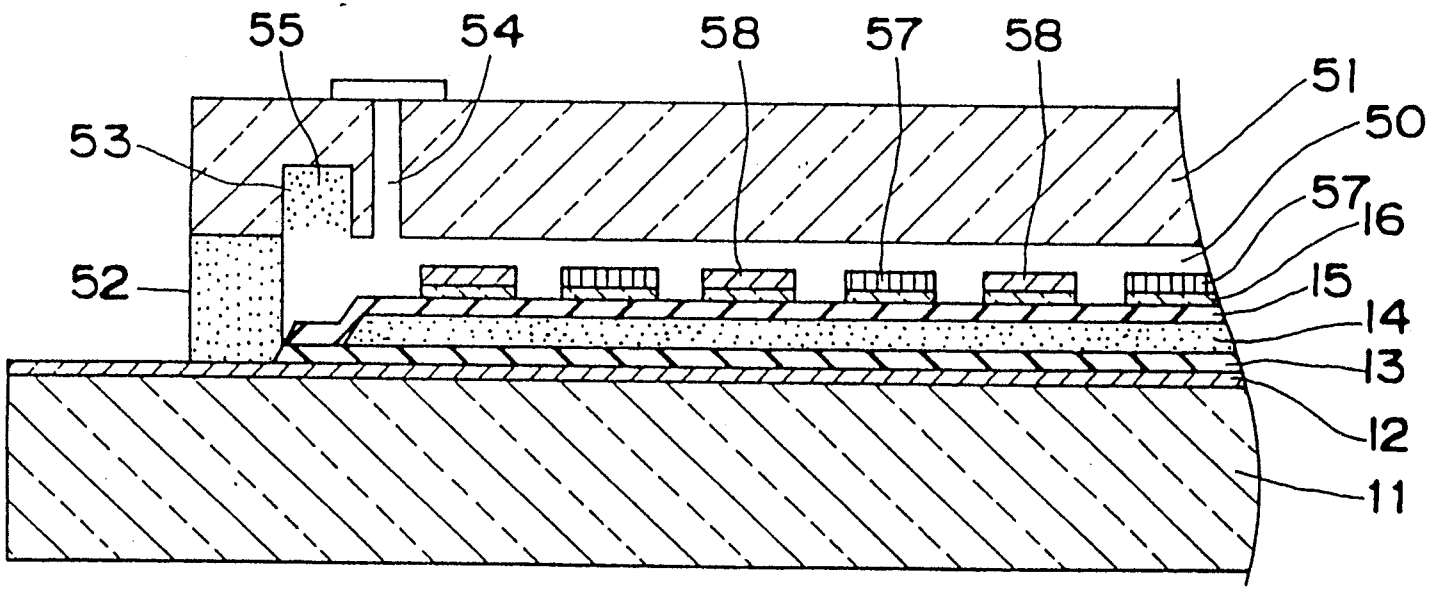
FIG. 10 is a sectional view of another modification of the fifth embodiment.

It is preferable to place a moisture absorption agent 55 in the groove 53 of the sealing glass plate 51, as shown in FIG. 10. By so doing, the moisture-resistance property of the thin-film EL device is further improved.

Figure 9:
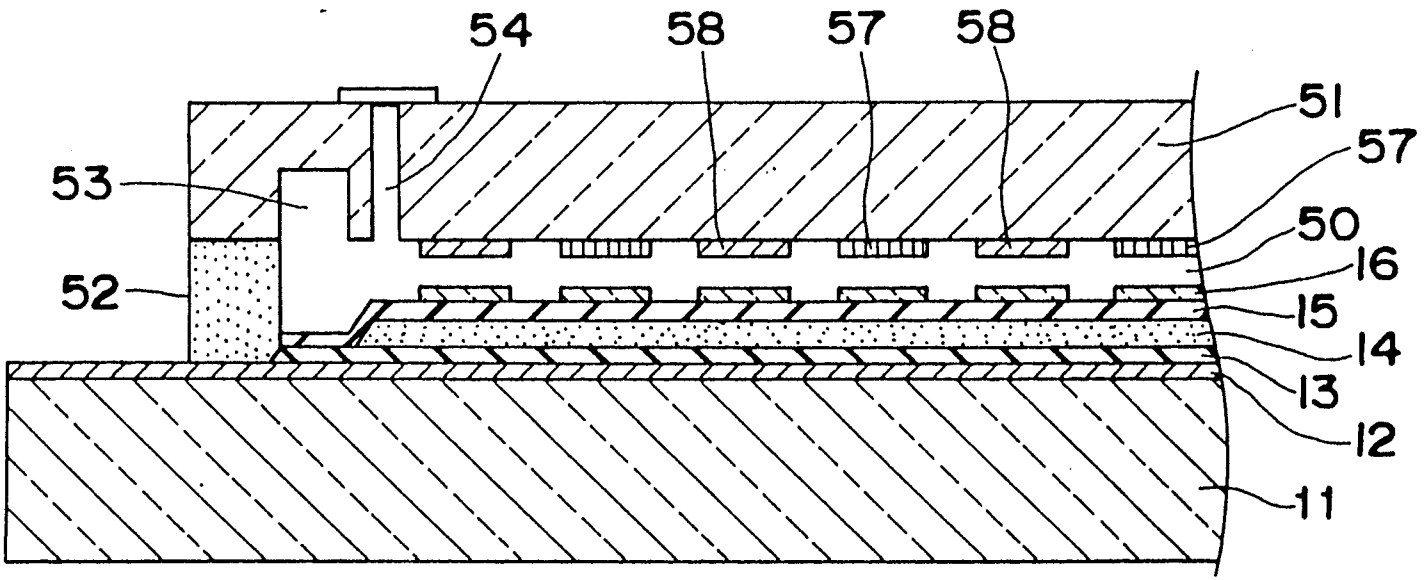
FIG. 9 is a sectional view of a modification of the fifth embodiment.

The color filters 57 and 58 can be placed on a lower surface of the sealing glass plate 51, as shown in FIG. 9, in a manner confronting the picture elements.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A thin-film electroluminescence display device comprising:

a substrate;

first electrodes formed on the substrate;

a first electric slayer formed on the the first electrodes;

a luminescent layer formed on the first dielectric layer;

a second dielectric layer formed on the luminescent layer;

second electrodes formed on the second dielectric layer; and a sealing plate formed above the second electrodes, the periphery of the sealing plate including a bonded portion which is adhesive-bonded to a peripheral portion of the substrate, said sealing plate including a groove adjacent said bonded portion, for capturing excess adhesive coming out from said bonded portion to avoid interference of said excess adhesive with display of the device, wherein said groove is peripherally located adjacent said bonded portion.

2. The thin-film electroluminescence display device of claim 1, wherein a moisture absorption agent is placed in said groove.

3. The thin-film electroluminescence display device of claim 1, wherein a substrate-side surface of said sealing plate is flat and color filters are formed between the second electrodes and the sealing plate.

4. The thin-film elecrroluminescence display device of claim 1, wherein a moisture absorption agent is placed in said groove, and wherein a substrate-side surface of aid sealing plate is flat and color filters are formed between the second electrodes and the sealing plate.

* * * * *